United States Patent [19]

Nowacki

[11] 4,217,815

[45] Aug. 19, 1980

[54] MACHINE FOR ERECTING STRAWBERRY LUG

[75] Inventor: Ulrich G. Nowacki, Leisure City, Fla.

[73] Assignee: International Paper Company, New York, N.Y.

[21] Appl. No.: 953,703

[22] Filed: Oct. 23, 1978

[51] Int. Cl.[3] ..... B31B 1/26

[52] U.S. Cl. ..... 93/37 R; 93/49 R; 93/49 M

[58] Field of Search ..... 93/37 R, 51 HW, 37 SP, 93/51 R, 36.3, 51 M, 49 M, 37 EC, 49 R; 229/27

[56] References Cited

U.S. PATENT DOCUMENTS

| | | | |
|---|---|---|---|
| 2,863,369 | 12/1958 | Crane | 93/37 SP |
| 3,318,204 | 5/1967 | Crane | 93/37 SP |
| 3,478,653 | 11/1969 | Byrne | 93/51 HW |
| 3,797,370 | 3/1974 | Sawada | 93/51 HW |
| 3,965,804 | 6/1976 | Elford | 93/51 HW |
| 3,978,774 | 9/1976 | Royal | 93/51 HW |
| 4,034,656 | 7/1977 | Raudat | 93/37 R |
| 4,159,797 | 7/1979 | Roozee | 229/27 |

FOREIGN PATENT DOCUMENTS

| | | | |
|---|---|---|---|
| 523805 | 4/1956 | Canada | 93/37 R |

*Primary Examiner*—Robert Louis Spruill
*Assistant Examiner*—K. Y. Lin
*Attorney, Agent, or Firm*—Stephen P. Gilbert

[57] ABSTRACT

Method and apparatus for forming a tray are disclosed. The tray has at least one transverse hollow wall formed by a pair of substantially parallel, spaced flaps that are folded down from a transverse bridge. Each flap is secured to a tab folded upwards from the bottom of the tray. A pair of pivotally-mounted folding arms located above the tray rotate the two flaps downwardly while a mandrel located beneath the tray forces the two tabs upwardly into a substantially parallel, spaced relationship, whereby each tab contacts and becomes secured to its respective flap.

12 Claims, 15 Drawing Figures

454
416
426
404
424
430
432
434
414
436
418
410
458
408
422
412
420
428
468
456
460
464
466
406

MACHINE FOR ERECTING STRAWBERRY LUG

BACKGROUND OF THE INVENTION

This invention is in the field of boxes and box-folding. More specifically, this invention relates to method and apparatus for erecting a tray having at least one transverse, hollow divider wall formed by two flaps folded downwardly from a transverse bridge into a substantially parallel, spaced relationship, wherein each flap is secured to a tab folded upwards from the bottom of the tray. For convenience, a tray having these features will be referred to as a "strawberry lug." One tray of this type is disclosed in U.S. Pat. application Ser. No. 881,169, filed Feb. 17, 1978, entitled "Shipping Container and Blank Therefor," hereby incorporated by reference.

U.S. Pat. No. 3,965,804 discloses a ram-operated crease-breaker that forces the lower panel of a partially formed tray upwardly into a die. The die is formed by two planes intersecting at an angle and has a U-shaped recess located at the imaginery line of intersection of the two planes. The die is rigidily mounted within a housing that is moved up and down by a second ram. The combined action of the two rams (the bottom ram moving the crease-breaker up and the upper ram moving the die down) is to crease and fold the lower panel into two vertical walls, one wall for each of two separate compartments.

U.S. Pat. No. 3,978,744 discloses a tray-forming machine having an expandable mandrel that forces a blank down into a die. While the expandable mandrel is disposed within the partially formed tray inside the die, a pair of pivotally mounted squeezer plates are brought into a substantially vertical position, thereby pushing connecting flaps against outer walls of the tray.

U.S. Pat. No. 2,863,369 discloses a machine for erecting walls of paperboard containers. A vertical reciprocating member is hingedly connected to several pairs of rigid link members, and the other end of each link is pivotally connected to one of several folding plates that are hingedly connected to the frame of the machine. Downward movement of the vertical member causes the folding plates to rotate downwardly from a horizontal to a vertical position, thereby folding down cross-partition and inner end wall panels.

U.S. Pat. No. 4,034,656 discloses a mandrel in a partition-straightening station of a box-forming machine, said mandrel having a plurality of downwardly pointing cones mounted on a support plate. Between each cone and the support plate is a die having the desired shape of its respective tray cell. Downward movement of the mandrel forces each cone and then its associated die between the partition walls, thereby aligning the walls of that cell.

SUMMARY OF THE INVENTION

Broadly, the present invention relates to method and apparatus for forming a strawberry lug. To erect such a tray, each tab must be folded upwards and held in position while its respective flap is folded downward, to allow securing of the tab to the flap. When glue is the securing means, the tab and flap must be brought into contact for a sufficient length of time to allow proper adhesion of flap to tab before the contacting means are removed. Additionally, the glue should not be visible in the finished tray. Finally, whatever securing means is used, tray erection should be rapid, foolproof, and economical.

These and other objections are achieved by means of apparatus built in accordance with the present invention. One such apparatus is a machine having several forming stations wherein one station comprises tab-folding means for folding the tabs towards the transverse bridge into a substantially parallel, spaced relationship, and flap-folding means for folding the flaps towards the tabs. In a preferred embodiment, the tab-folding means of that station is a reciprocating mandrel (or ram) and the flap-folding means is a pair of rotatably-mounted folding plates, the mandrel and folding plates cooperating in a manner to be described. This station may be said to contain a "folding-ram assembly."

None of the patents discussed above discloses such apparatus, let alone cooperating folding plates and mandrel.

BRIEF DESCRIPTION OF THE DRAWINGS

In order to more fully describe the present invention, the following drawings are provided in which:

FIGS. 13 and 14 are partial end views showing the partially erected lug in the final forming station, which contains the folding-ram assembly.

Figure 1:
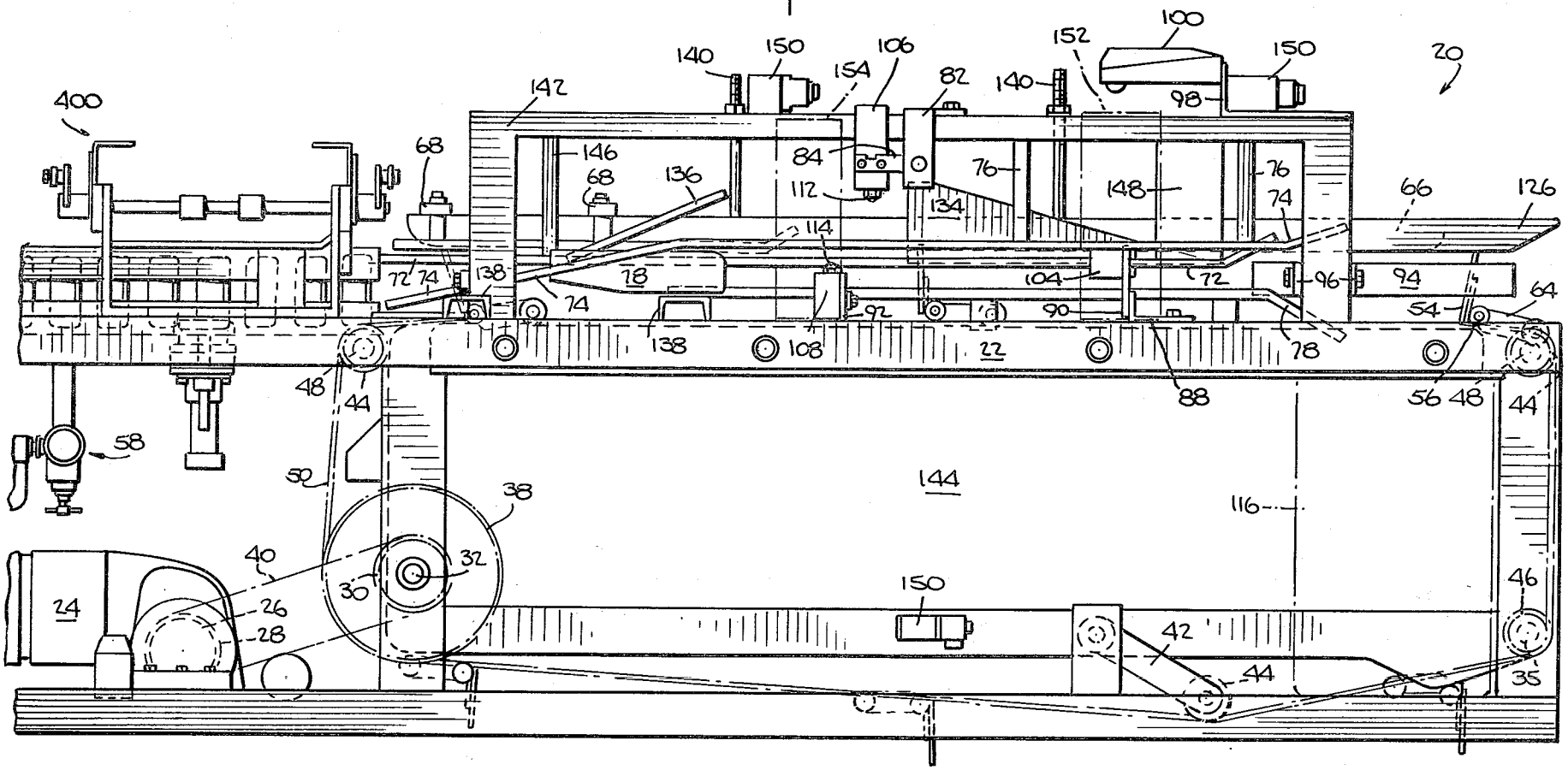
FIG. 1 is a partial, side view of a strawberry lug-forming machine, one of whose stations contains a folding-ram assembly.

These drawings are for illustrative purposes only and should not be construed to limit the scope of the invention.

DETAILED DESCRIPTION OF THE INVENTION

This invention relates to method and apparatus for erecting a strawberry lug, and, in particular, for erecting the one or more hollow divider wall(s) of the tray. Such trays may be used for transporting produce, such as, strawberries, in small baskets. Several of these trays may be stacked within a box for shipping.

These trays may be made from paper products, e.g., paperboard, or from other materials capable of holding the desired tray shape and having satisfactory physical properties, for example, tensile strength. The tray may be of any size, but generally is from 14 to 24 inches long, 8 to 16 inches wide, and 2.5 to 6 inches deep and has the configuration shown in FIG. 6B (view 374).

Blanks for a strawberry lug may be made by machine or hand, preferably by machine. Such blanks may be pre-printed, pre-folded, and stored until needed.

One embodiment of the present invention is shown in the drawings, which embodiment is a lug-erecting machine having a folding-ram assembly for forming the hollow divider wall of the lug.

For clarity, certain obvious elements have been omitted in the drawings. For example, the control panel, electrical wiring, pneumatic lines, most of the air supply system, the glue unit, tubing connecting the glue unit to the glue guns, the exit pusher assembly (which ejects the formed strawberry lug from the machine, over a waterfall, and onto the outfall tracks), and the outfall tracks are not shown. The construction, placement, and functioning of these and the other missing items will be obvious to one skilled in the art. Additionally, again for the sake of clarity, certain elements shown in one figure may not be shown in the other figures.

Figure 2:
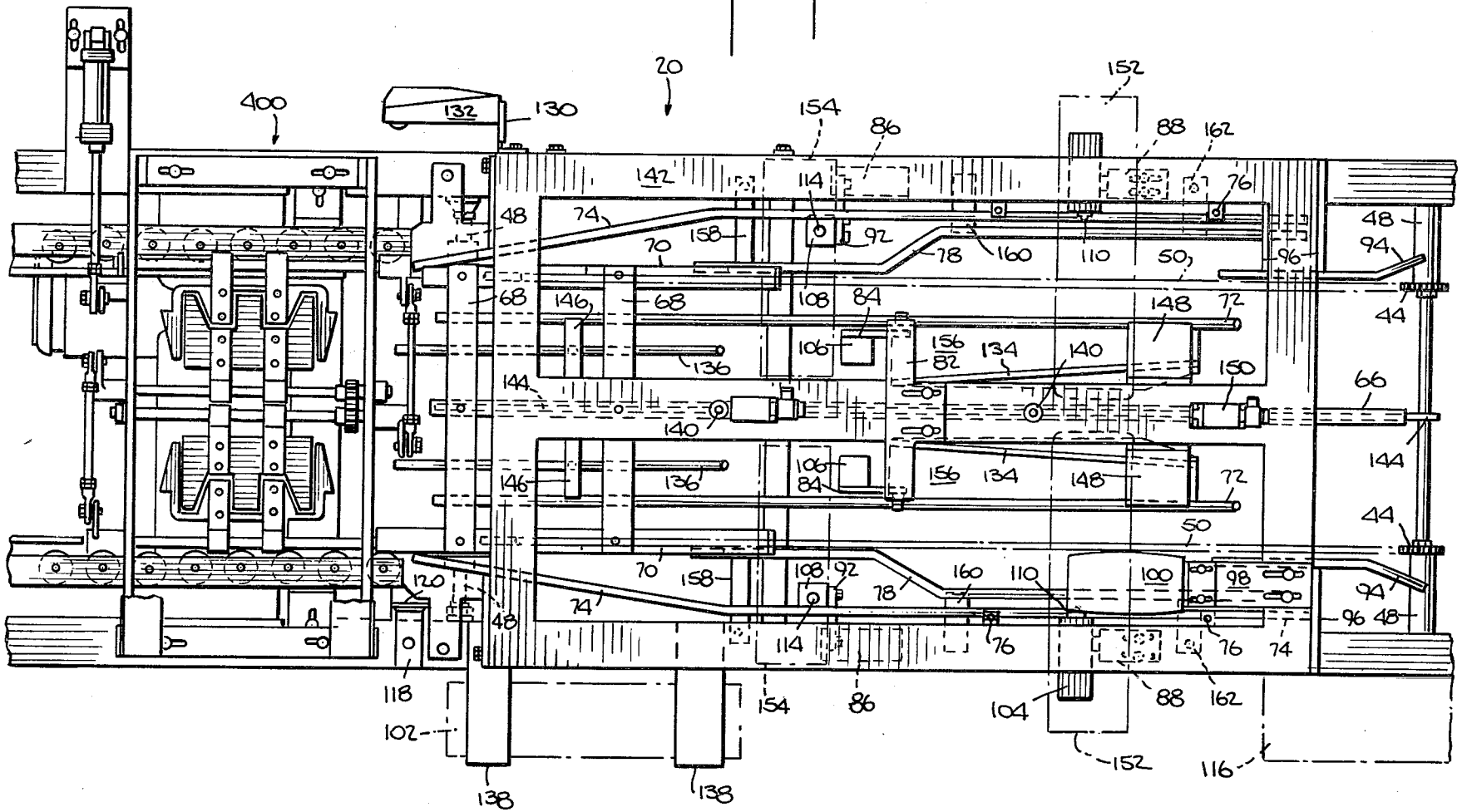
FIG. 2 is a partial, top view of the machine of FIG. 1.
Figure 3:
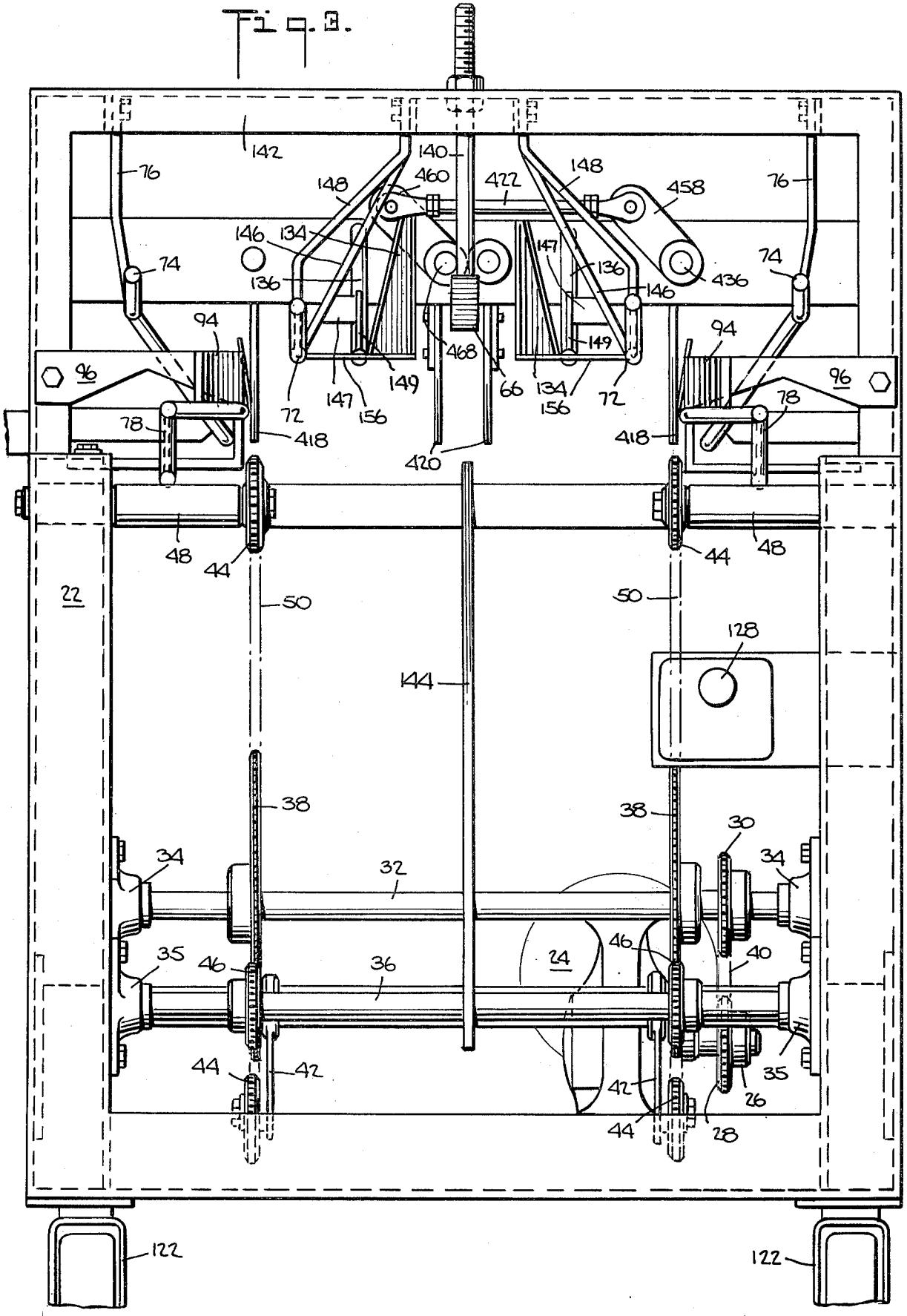
FIG. 3 is a partial end view of the machine of FIG. 1.

Turning now to the drawings, FIGS. 1, 2, and 3 are, respectively, partial side, top, and end views of machine 20, which erects the strawberry lug. Not shown in FIGS. 1 or 3 are emergency stop button 128 or casters 122.

Machine 20 comprises lower frame 22 and upper frame 142. The folding-ram station, indicated by reference numeral 400, is located at the left of FIGS. 1 and 2. A partially pre-folded blank is placed by an operator between infeed flap guides 94 (at the right of FIGS. 1 and 2), and the blank is pushed through all of the forming stations except the last (the folding-ram station) by one of six flight bars 54, which are attached to the two roller chains 50 by chain attachment links 56. (Six flight bars 54 are shown attached to roller chains 50; however, more or less may be used, depending primarily on the width of the lug.)

Motor 24, acting through torque limited 26, rotates sprocket wheel 28 in a counter-clockwise direction in FIG. 1. Roller chain 40 transmits this counter-clockwise motion to sprocket wheel 30 and, thus, to large sprocket wheels 38 (sprocket wheels 30 and 38 are rigidly mounted on shaft 32, which is itself rotatably mounted in bearings 34). Movement of sprocket wheels 38, in turn, causes counter-clockwise movement of roller chains 50, which ride on sprocket wheels 38, 44, and 46. Sprocket wheels 44 are rotatably mounted on idler arms 42 or outriggers 48, and sprocket wheels 46 are rigidly attached to shaft 36, rotatably mounted in bearings 35.

Figure 8:
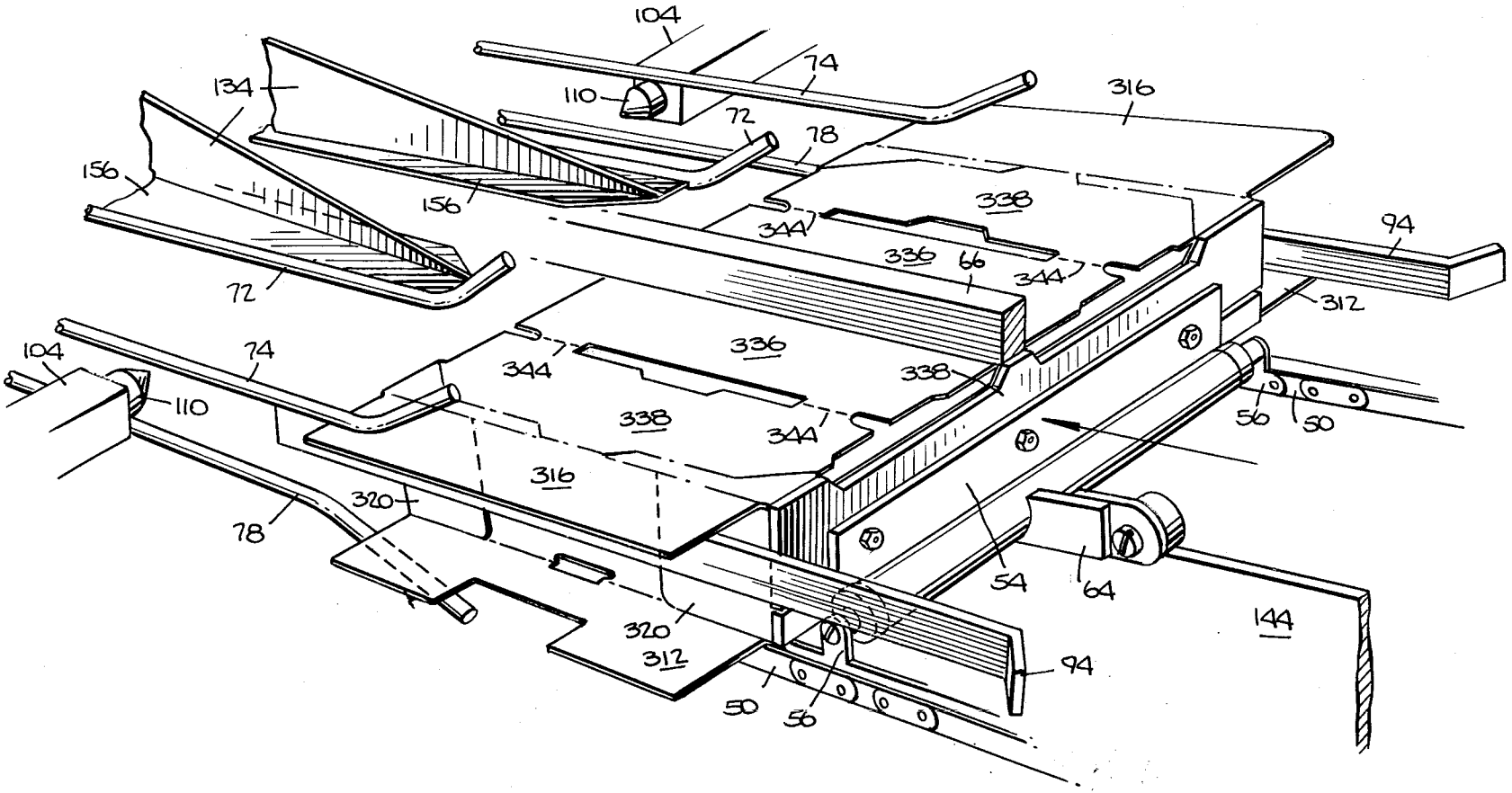
FIG. 8 shows a squared-up blank of FIG. 5 being fed to the first forming station of the machine of FIG. 1.

Flight bar aligners 64 are attached to flight bars 54 and ride on frame center panel 144 to maintain proper orientation of the flight bars (see, also, FIG. 8). Flap-scoring mandrel 66 is attached to upper frame 142 by support bars 140. Mandrel extension 126, shown only in FIG. 1, is attached to mandrel 66. A portion of air supply system 58 is shown at the left of FIG. 1.

To fold the flaps of the blank, various plowbars, rods, and plates are provided. Inner flap scoring plows 72 are attached to inner flap plowbars 134 by support plates 156 and are attached to upper frame 142 by forward supports 148 and rear supports 146. Plowrod hangers 76 connect top flap plowrods 74 to upper frame 142. Outside flap plowbars 78 are connected to lower frame 22 by rear, middle, and forward support bars 158, 160, and 162, respectively, and top support brackets 70. Plowbars 78 are, for most of their length, rod-shaped, but become bar-shaped at one end. This is most easily seen in FIG. 1. Inner flap plowrods 136 are connected to supports 149, which are attached to supports 147, which, in turn, are carried by supports 146.

Three pairs of glue guns apply glue to the lug as it is erected. Forward glue guns 104, having nozzles 110, are attached to lower frame 22 by mounting plate 88 and mounting supports 90. Internal glue guns 106, having nozzles 112, are attached to upper frame 142 by mounting plate 82 and supports 84. Rear glue guns 108, having nozzles 114, are attached to lower frame 22 by mounting plates 86 and supports 92.

Three photoelectric cells, only two of which are shown, are used for control purposes. When the blank breaks a beam of light associated with a particular photocell, one or more machine functions are activated. Photocell assembly 100 (including a light source, a photoelectric cell, and a function circuit card) is attached to upper frame 142 by mounting plate 98. The reflector for this photocell assembly is mounted on frame 22 below the assembly but is not shown in the drawings. Rear photocell assembly 132 is attached to upper frame 142 by mounting plate 130. Reflector 120, associated with photocell assembly 132, is attached to lower frame 22 by bracket 118.

The locations of forward and rear glue shields 152 and 154, respectively, are shown in dotted lines. In FIG. 2, the normal location of glue unit 102, which rests upon support bars 138, is shown in dotted lines. The location of the control panel 116 is also shown in dotted lines.

Other support elements shown are supports 96, connecting infeed flap guides 94 to upper frame 142, and top support base bars 68, to which top support brackets 70 are attached. Bars 68 sit above and are attached to flap-scoring mandrel 66. Air valves/mufflers 150 are also shown in FIG. 1.

Finally, in FIG. 3 several parts of folding-ram assembly 400 are shown. Cranks 458 and 460 are rotatably mounted in frame 408 on shafts 436 and 468, respectively, and are connected to one another by forward ocnnecting rod 422. Outer and inner folding plates 418 and 420, respectively are shown in their normal position, that is, folded down.

Figure 4:
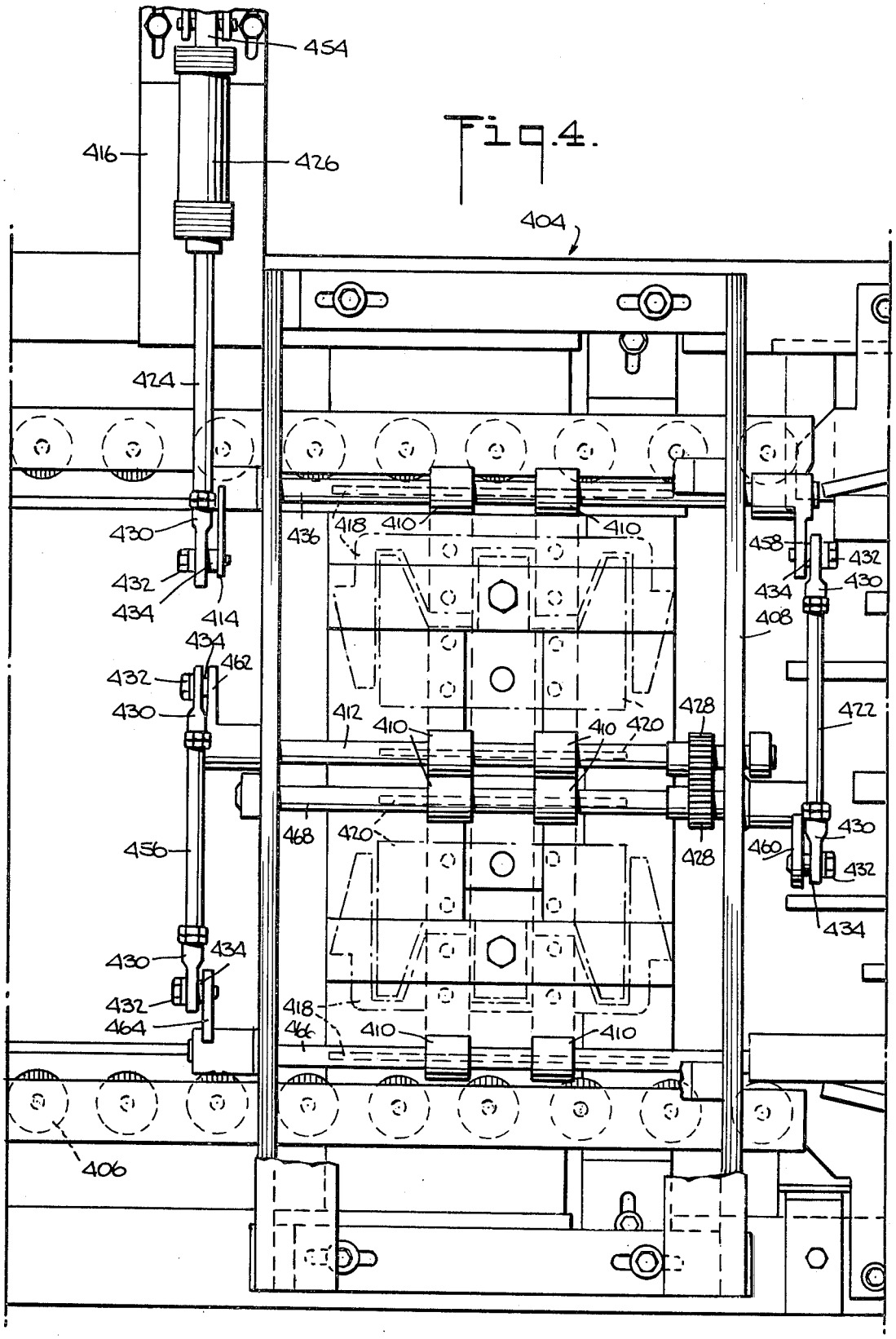
FIG. 4 is an enlarged top view of the folding assembly of the folding-ram assembly of FIG. 1.

FIG. 4 is a top view of folding assembly 404 of folding-ram station 400. Center shafts (jackshafts) 412 and 468 are rotatably mounted within frame 408 and are functionally connected by meshed Boston gears 428. Outer shafts 436 and 466 are also rotatably mounted within frame 408. Four pairs of folding arms 410 connect outer folding plates 418 to outer shafts 436 and 466 and connect inner folding plates 420 to center shafts 412 and 468.

Crank 458 is rigidly attached to outer shaft 436 and rotatably connected to forward connected rod 412 through bearing 430 and bolt 432. Spacer 434 separates the crank handle from the bearing. The other end of rod 422 is rotatably connected to center shaft 468 by a similar bearing, bolt, and spacer arrangement.

Rotation of center shaft 468 causes counter-rotation of center shaft 412 through meshed gears 428. Shaft 412 carries crank 462, which, in turn, is rotatably connected to rear connecting rod 456 by bolt 432 and bearing 430, separated by spacer 434. The other end of rod 456 is rotatably connected to crank 464 by a similar bolt, bearing, and spacer arrangement. Crank 464 is rigidly mounted on shaft 466.

Air cylinder 426 is pivotally connected to mounting plate 416 by means of clevis 454. Air cylinder 426, which is double air-actuated, normally keeps driveshaft 424 extended from the cylinder. Driveshaft 424 is rotatably connected to crank 414 by bolt 432 and bearing 430, with spacer 434 in between. The strawberry lug travels through folding-ram station 400 between rollers 406, only one of which is labeled.

Figure 5:
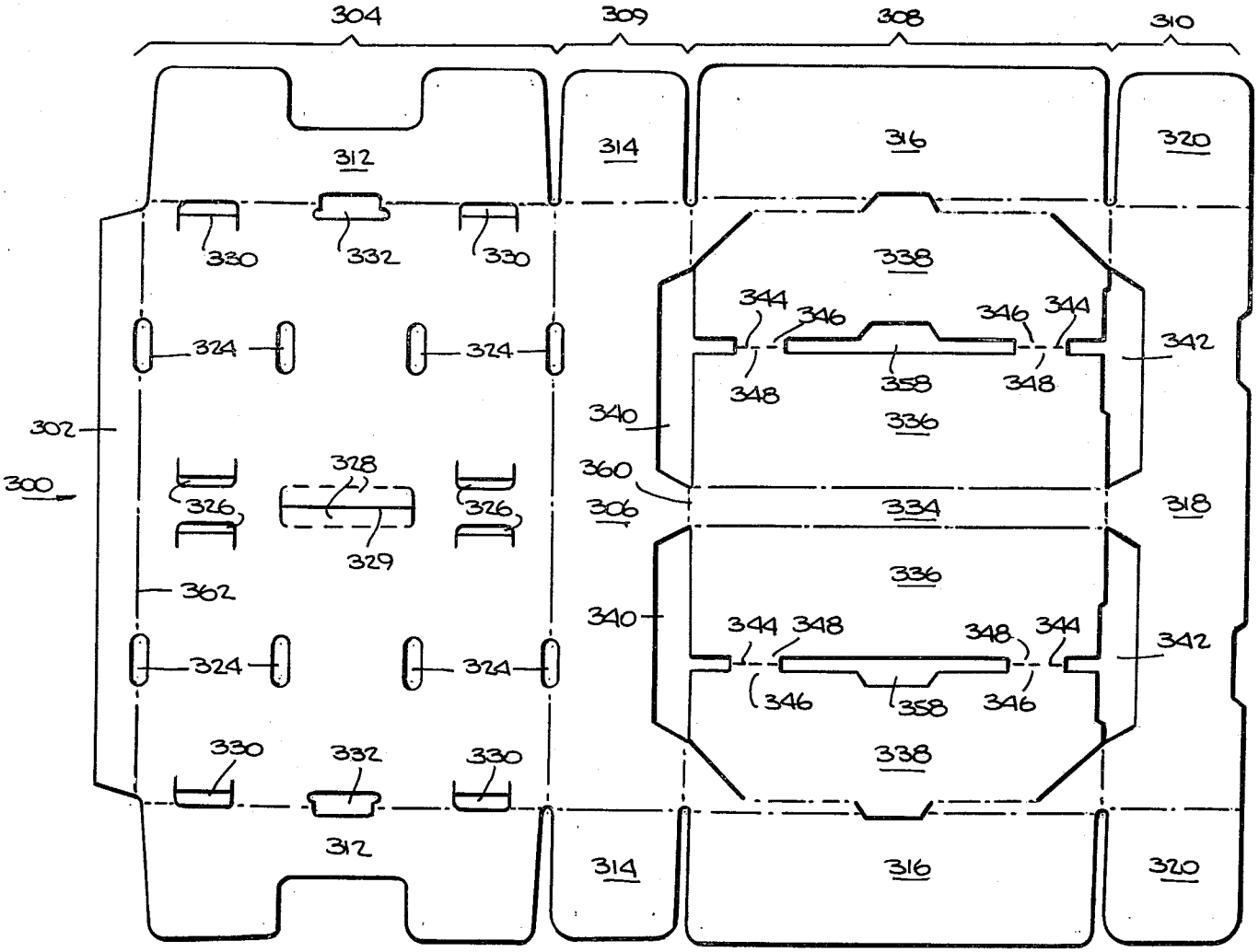
FIG. 5 is a plan view of a preferred blank from which a strawberry lug may be formed.

FIG. 5 is a plan view of a preferred blank 300, from which a strawberry lug may be erected. Blank bottom assembly 304 comprises bottom end flaps 312 and bottom wall panel 322. Glue flap 302 lies to the left of bottom wall panel 322. Blank bottom assembly 304 contains ventilation holes 324, center tab holes 326, and tab holes 330, tab holes 332, and center tabs 328, separated by cut-score line 329.

Blank top assembly 308 comprises top end flaps 316, transverse bridge panel 334, center wall panel flaps 336, and inner end panel flaps 338. Cut-score lines 344 lie between each pair of inner end panel tabs 346 and center wall panel tabs 348.

Side wall assembly 309 comprises side end flaps 314 and side wall panels 306. Side wall assembly 310 comprises side end flaps 320 and side wall panel 318. Also shown are cut-outs 340, 341, and 358.

Dashed lines in the drawing indicated score lines in the blank along which folding will occur.

Before this blank can be erected by the machine of FIG. 1, the blank is folded along major score lines 360 and 362, and flap 302 is glued to side wall panel 318. The configuration of the blank following this step is shown as view 364 in FIG. 6A. The blank is then "squared up," that is, transversely compressed so that side wall panels 318 and 306 become perpendicular to top and bottom assemblies 308 and 304. Additionally, the trailing pair (and, optionally, the leading pair) of side end flaps 320 are folded inwardly, as shown in view 366 of FIG. 6A, where both pairs of flaps 320 have been folded. (By "leading" or "trailing" is meant, respectively, closer to, or farther from, the discharge end of the machine, to the left in FIG. 1.)

As will be appreciated, because the blank in view 366 occupies more space than in view 364, the blank is usually transported to the machine of FIG. 1 while flattened (view 364). The blank is then squared-up, one or both pairs of side end flaps 320 are folded inwardly (view 366), the blank is placed on roller chains 50 between infeed flap guides 94, and the next available flight bar 54 starts the movement of the blank through the machine.

Figure 6A:
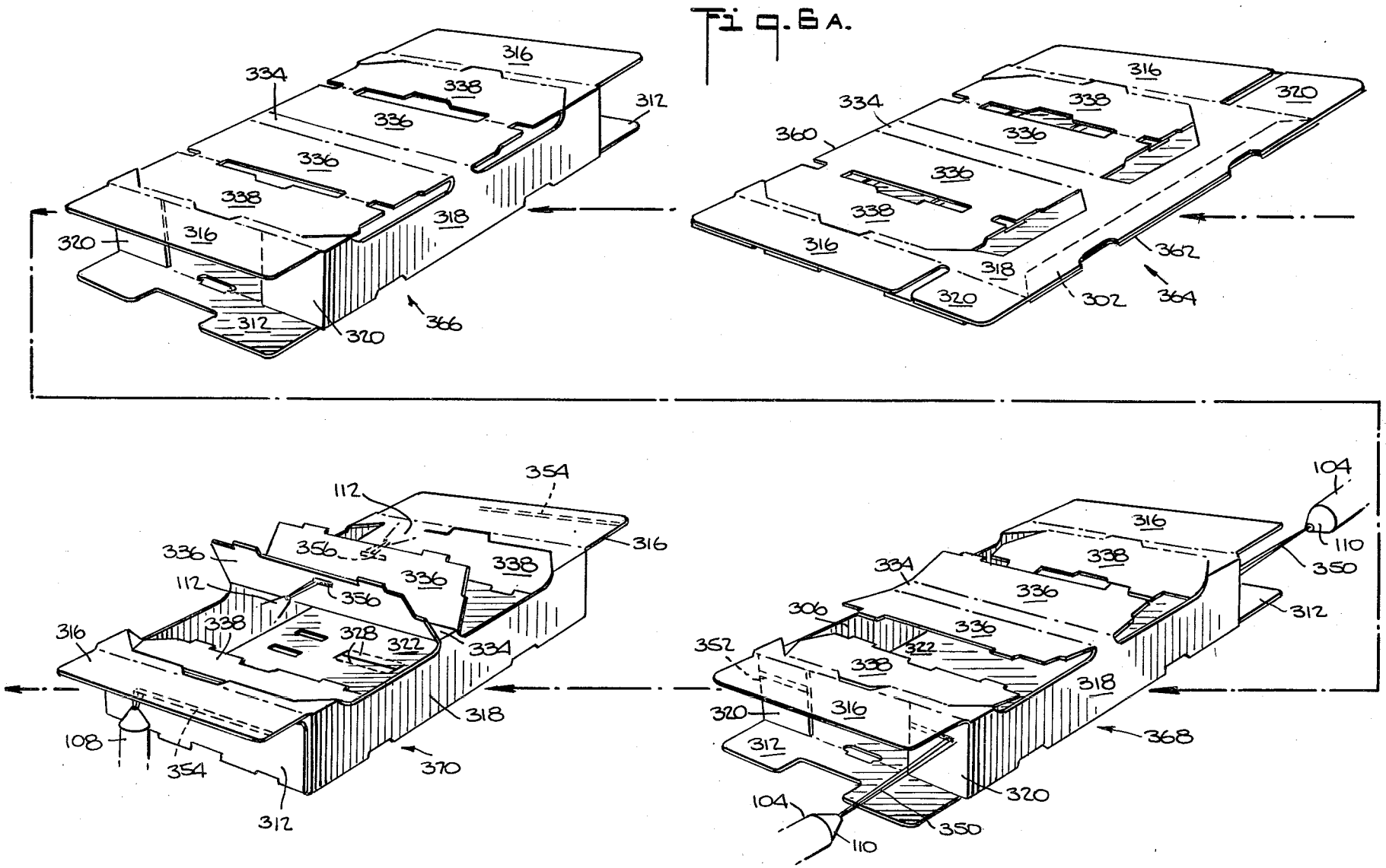
FIG. 6 (6A and 6B) show sequential views of a strawberry lug being erected from the blank of FIG. 5.

View 368 of FIG. 6A shows center wall panel flaps 336 separated from inner end panel flaps 338. The center wall panel flaps have been moved up, away from bottom wall panel 322, and the inner end panel flaps have been rotated downwardly, towards panel 322. Additionally, glue 350 is being shot from glue guns 104 and nozzles 110 onto side end flaps 320 to form glue lines 352 (only one of which is shown).

In view 370, bottom end flaps 312 have been folded upwardly to contact and adhere to side end flaps 320. Glue is being shot from internal glue gun nozzles 112 to form glue lines 356 on center wall panel flaps 336, which have been rotated upwardly. Glue lines 354 are being formed on the underside of top end flaps 316 by glue shot from rear glue guns 108 (only one of which is shown).

Figure 6B:
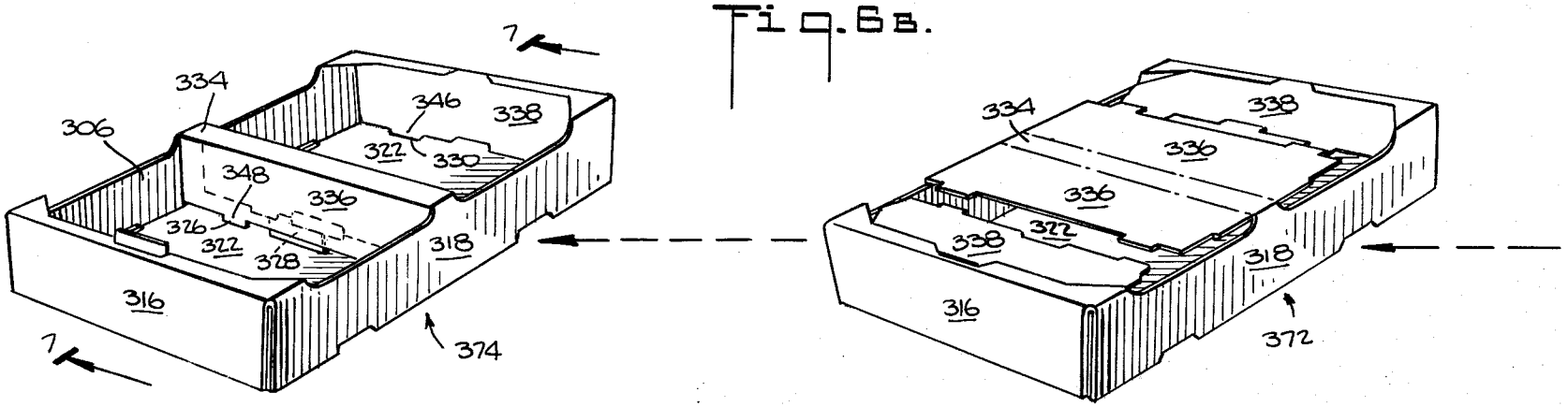

View 372 of FIG. 6B shows top end flaps 316 rotated downwardly to contact and adhere to bottom end flaps 312. Also, center wall panel flaps 336 have been rotated downwardly, to a plane approximately parallel to bottom wall panel 322.

The finished strawberry lug is shown in view 374. Center wall panel flaps 336 have been folded downwardly so that they are substantially parallel to one another and are separated by transverse bridge panel 334. Center wall panel tabs 348 have been inserted into center tab holes 326, and center tabs 328 have been folded upwardly into a substantially parallel spaced relationship. Each center tab 328 is attached to its respective center wall panel flap 336 by glue line 356. Also, inner end panel flaps 338 have been folded downwardly so that they are substantially perpendicular to bottom wall panel 322, and are held in place by inner end panel tabs 346, which are inserted into end tab holes 330.

Figure 7:
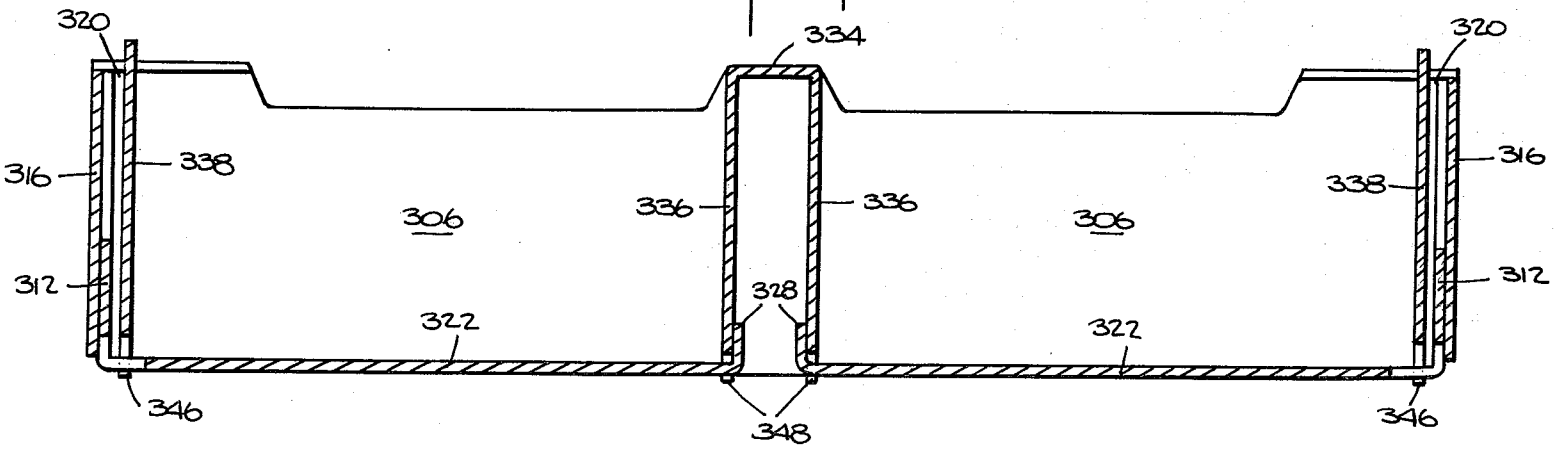
FIG. 7 is a side view of a strawberry lug made from the blank of FIG. 5, said view taken along line 7—7 of the last view in FIG. 6B.

FIG. 7 is a cross-sectional view of view 374 of FIG. 6B, taken along line 7—7, and shows inner end panel flaps 338 lying next to side end flaps 320. Bottom end flaps 312 lie between top end flaps 316 and side end flaps 320. Center wall panel flaps 336 are substantially parallel to one another and are adhered to center tabs 328. The ends of inner end panel tabs 346 and of center wall panel tabs 348 project below bottom wall panel 322.

FIG. 8 shows the blank of view 366 having just been fed to the machine of FIG. 1 for erection. The blank rides on roller chains 50 and is being pushed by flight bar 54, which is connected to roller chains 50 by chain attachment links 56. Flight bar aligner 64 rides on frame center panel 144 to maintain flight bar 54 in the proper orientation with respect to the blank.

As the blank moves in the machine direction (from right to left, as indicated by the arrow), bottom end flap 312 will be moved upwardly by outside flap plowbars 78, and top end flaps 316 will be rotated downwardly by top flap plowrods 74. Glue will be shot from glue guns 104 through nozzles 110 onto side end flaps 320. Center wall panel flaps 336 will be rotated upwardly by inner flap plowbars 134, and inner end panel flaps 338 will be rotated downwardly by inner flap scoring plows 72, thereby separating center wall panel flaps 336 from inner end panel flaps 338 at cut-score lines 344.

Figure 9:
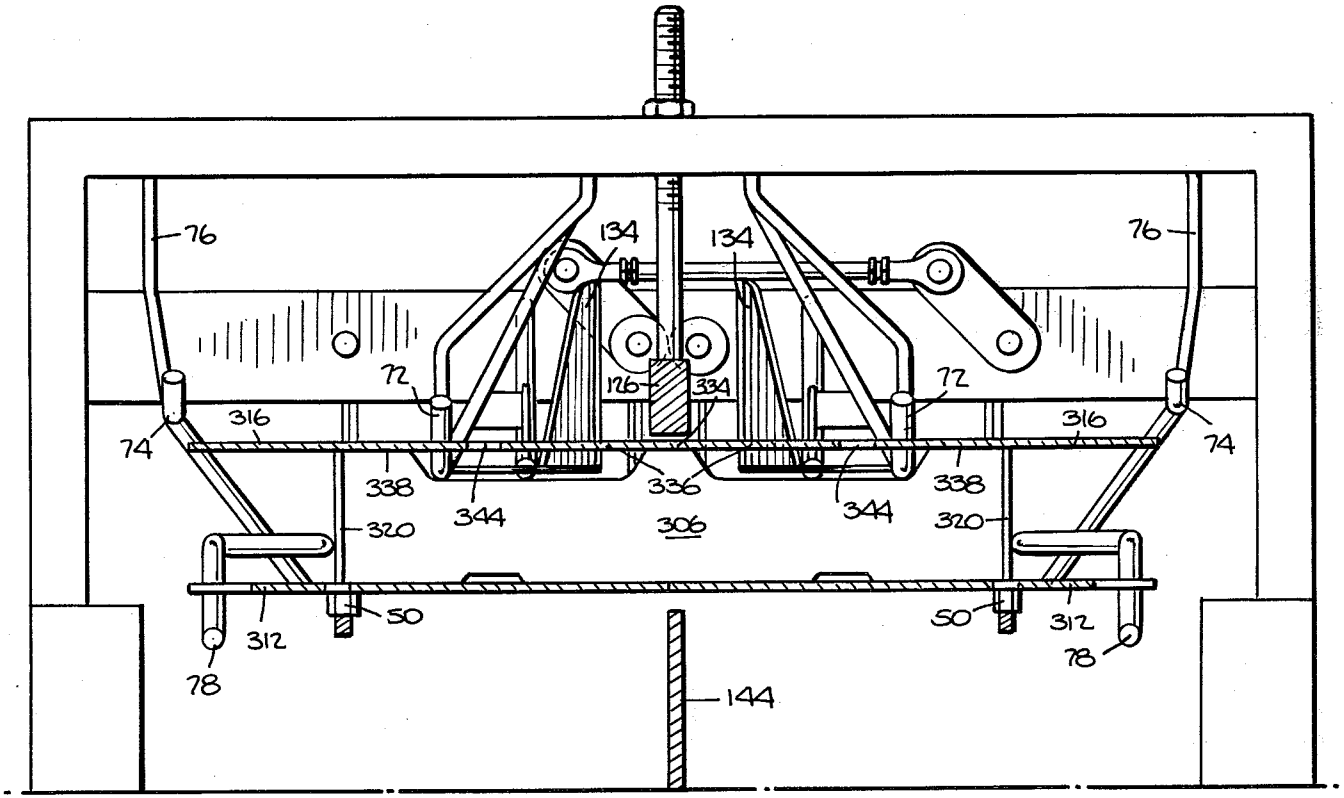
FIGS. 9 to 12 are partial end views showing the squared-up blank of FIG. 8 passing through the forming stations of the machine of FIG. 1 before reaching the folding-ram assembly.

FIGS. 9 to 14 are partial end views of the machine of FIG. 1, looking along the machine direction. Many elements are omitted from these drawings so that the co-action of the machine and blank during lug erection may be more clearly seen. Additionally, for clarity, only a sectional view of the blank, taken along line 7—7 of FIG. 6B is shown in these drawings. FIG. 9 is a sectional end view of FIG. 8 (note that infeed flap guides 94 and glue guns 104 are not shown).

Figure 10:
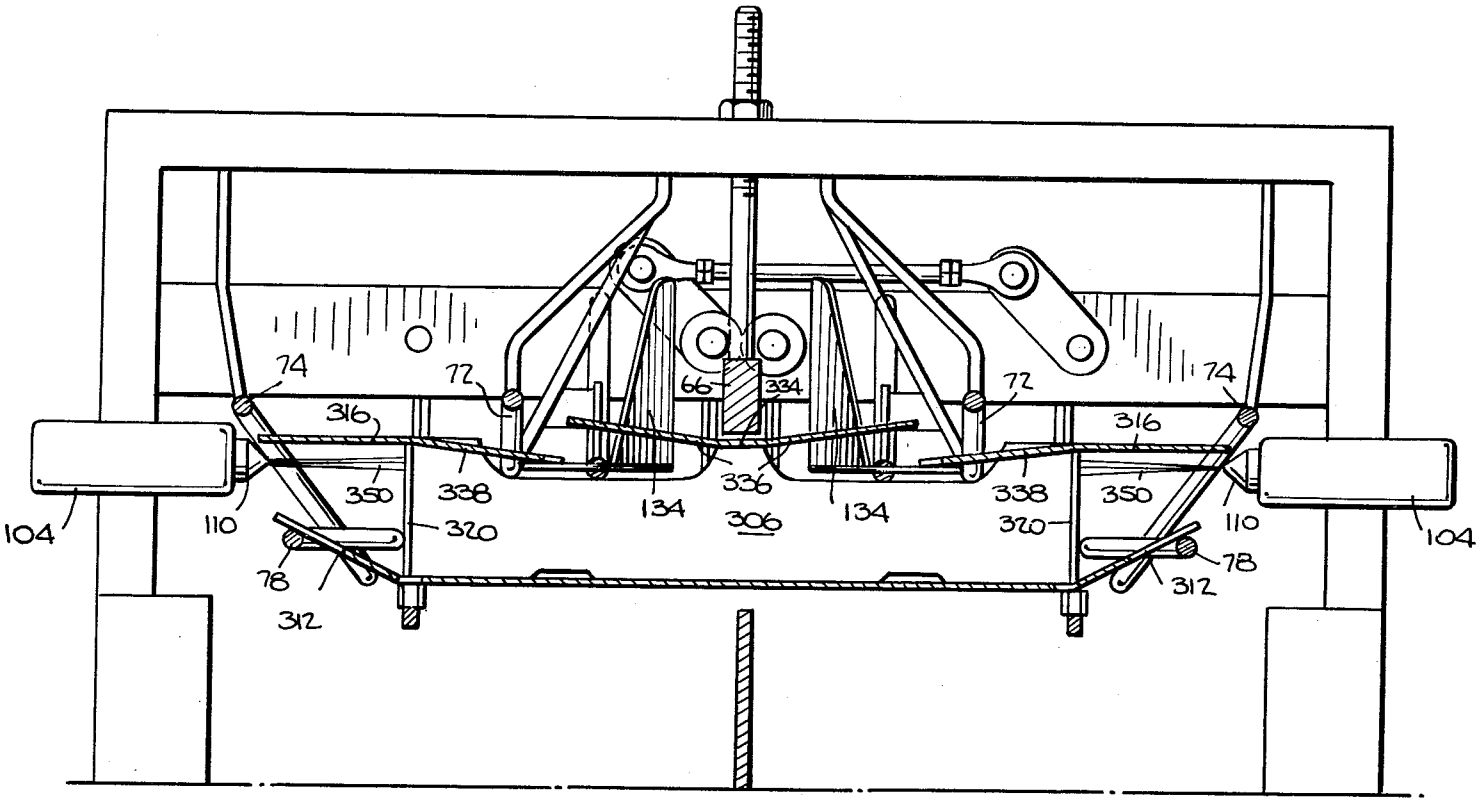

FIG. 10 shows the blank moved farther along the machine. Top end flap 316 and bottom end flap 312 have broken the light beam associated with photocell 100 (FIGS. 1 and 2), and this, in turn, has caused glue guns 104 to shoot glue 350 at side end flaps 320. Additionally, bottom end flaps 312 have been brought into contact with outside flap plowbars 78, causing those flaps to rotate upwardly. The leading edges of center wall panel flaps 336 have been pushed against inner flap plowbars 134, and inner end panel flaps 338 have been pushed against inner flap scoring plows 72. This has separated center wall panel flaps 336 from inner end panel flaps 338 along cut-score lines 344, upwardly rotated the former, and downwardly rotated the latter.

Figure 11:
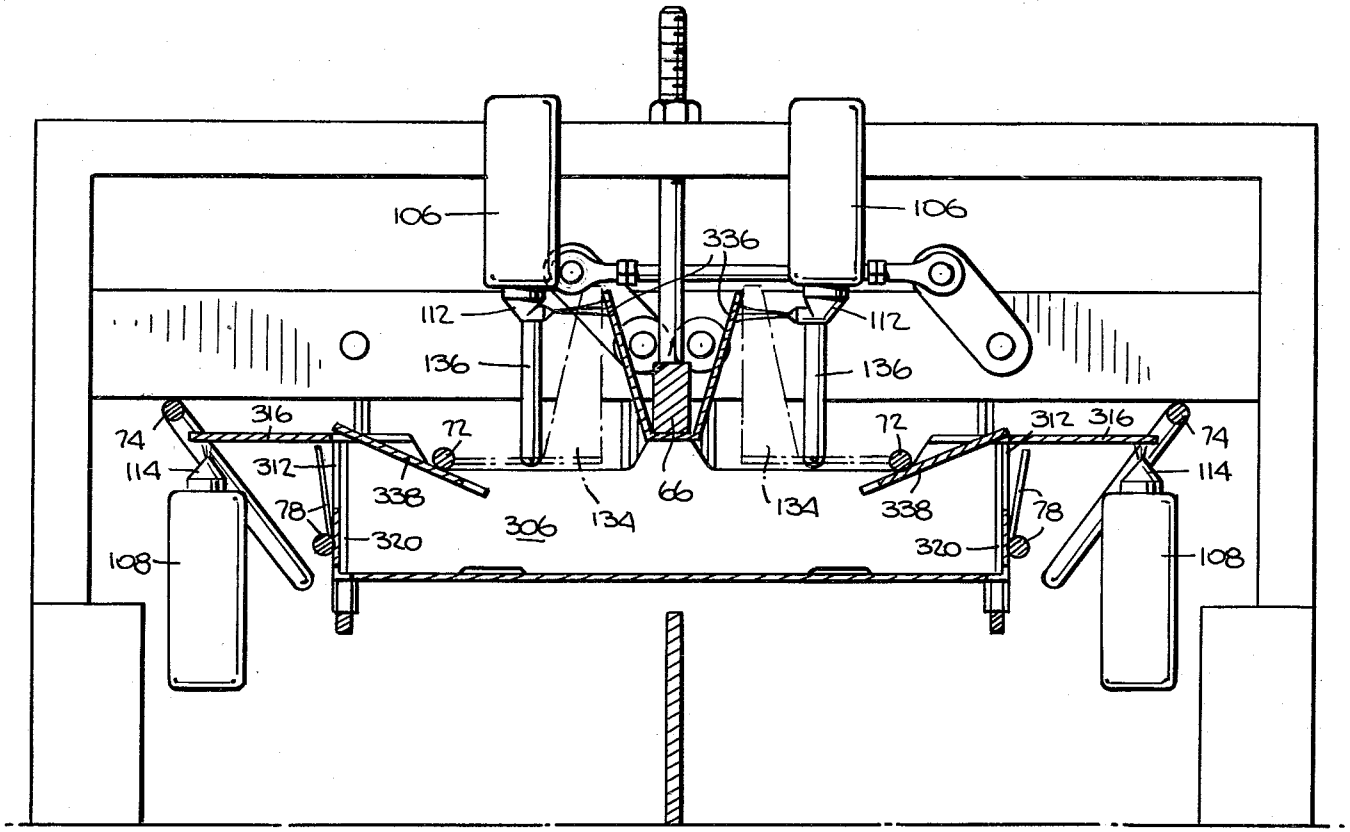

In FIG. 11, the blank has progressed sufficiently through the machine so that bottom end flaps 312 have contacted the end, bar portions of outside flap plowbars 78, causing bottom end flaps 312 to contact the glue previously applied to the outside of side end flaps 320. At this point, left top end flap 316 is no longer breaking the beam of light associated with photocell 100. This has caused rear glue guns 108 to apply glue to the underside of top end flaps 316 and internal glue guns 106 to apply glue to center wall panel flaps 336. The trailing portions of center wall panel flaps 336 are still contacting inner flap plowbars 134 (shown in dotted lines), thus holding center wall panel flaps 336 sufficiently upright for application of the glue. Inner end panel flaps 338 are still being depressed by inner flap scoring plows 72.

Figure 12:
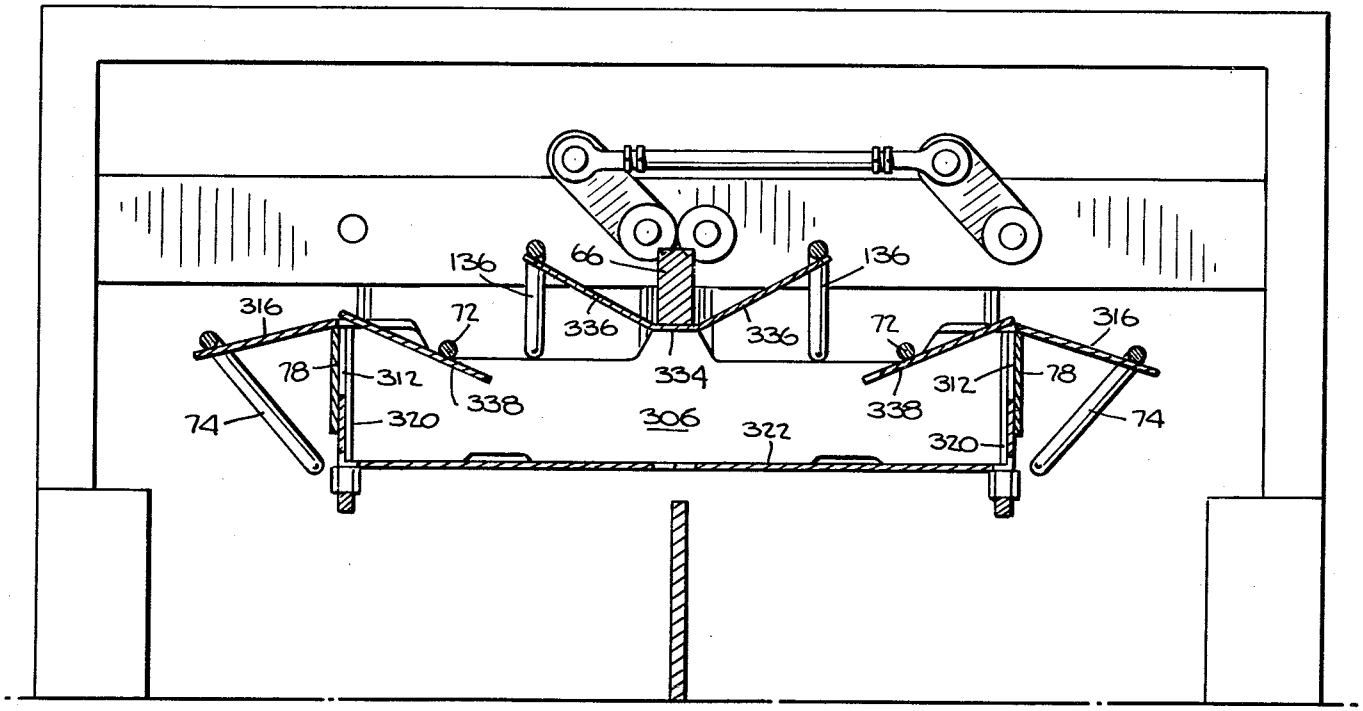
Figure 19:
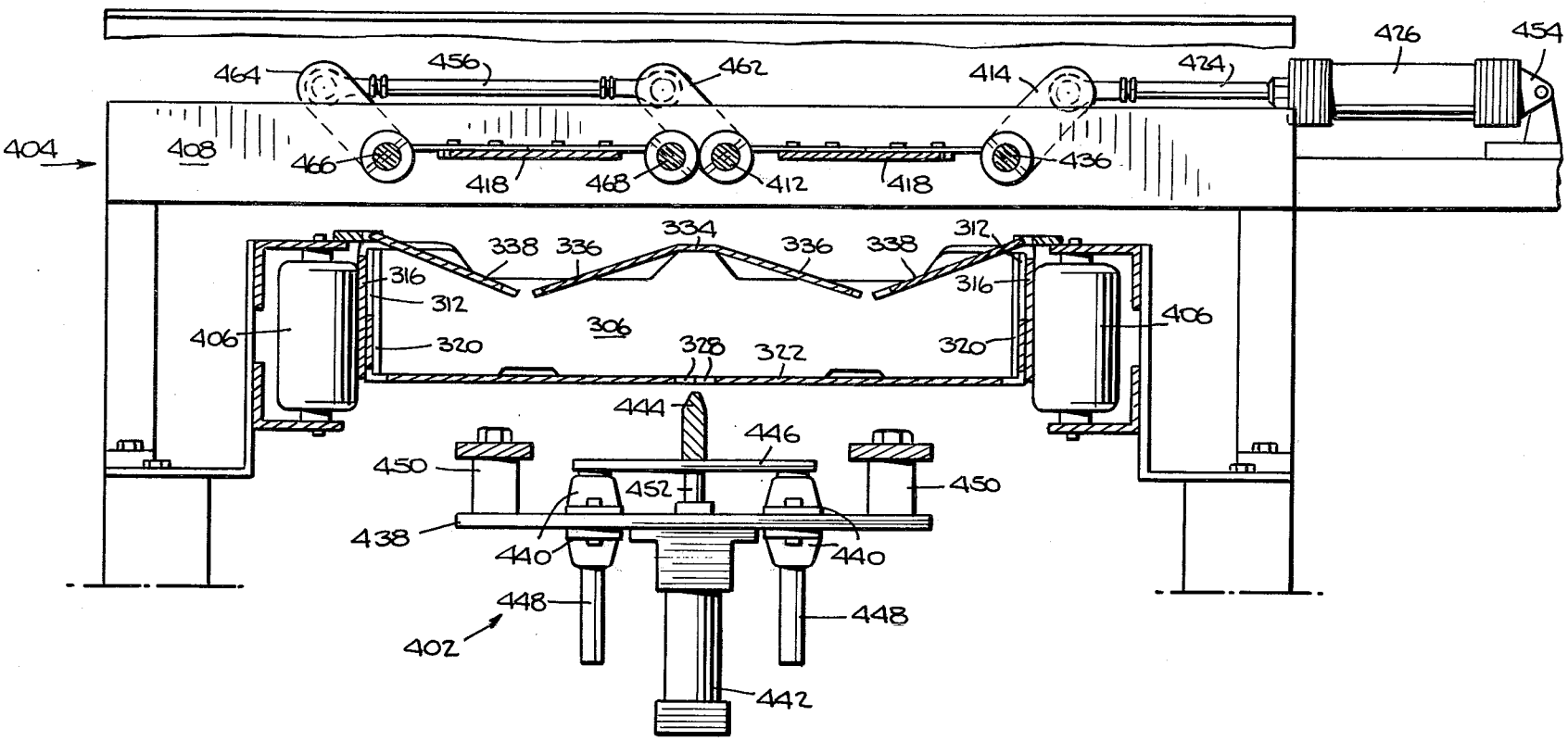

FIG. 12 shows the blank at a point where top end flaps 316 are being forced against top flap plowrods 74, causing the flaps to rotate downwardly. The bar portions of outside flap plowbars 78 are still contacting bottom end flaps 312. Inner end panel flaps 338 are still being depressed by inner flap scoring plows 72, and transverse bridge panel 334 is lying against flap-scoring mandrel 66. Center wall panel flaps 336 are contacting inner flap plowrods 136, thereby downwardly rotating flaps 336, which no longer contact inner flap plowbars 134 as in FIG. 11.

Further progression of the blank through the machine causes flaps 316 to contact, and thereby adhere to, bottom end flaps 312, and causes inner flap plowrods to rotate center wall panel flaps 336 downwardly to point towards bottom wall panel 322. Additionally, the leading edge of the blank interrupts the beam of light associated with photocell assembly 132 (see FIG. 2), causing air cylinder 426 (FIG. 13) to pressurize so as to retract driveshaft 424. This retraction pressurization ultimately causes outer folding plates 418 and inner folding plates 420 to rotate upwardly into a horizontal position, as will be explained below. Flight bar 54 continues to push the blank until the latter has entered the folding-ram station. (Because of reliability, it is preferred that air cylinders 426 and 442 be double air-actuated; however, either could be single air-actuated and contain biasing means, e.g., a spring, to keep its piston normally extended or retracted. Furthermore, solenoids or other reciprocating means could be used instead of air cylinders.)

Referring to FIGS. 4 and 13, retraction of driveshaft 424 causes cranks 414 and 458 and shaft 436, on which both cranks are rigidly mounted, to rotate clockwise. (In discussing operation of the folding-ram assembly, the directions "clockwise," "counter-clockwise," "right," and "left" are with reference to FIG. 13.) This moves forward connecting rod 422 to the right (in the same direction as driveshaft 424 moves when it retracts), causing clockwise rotation of left center shaft 468.

Because of the interconnection of center shafts 468 and 412 by meshed gears 428, clockwise rotation of shaft 468 results in counter-clockwise rotation of shaft 412. Crank 462 then rotates in a counter-clockwise fashion and pushes rear connecting rod 456 to the left (away from the air cylinder), which causes counter-clockwise rotation of crank 464 and left outer shaft 466. The four folding plates, attached to shafts 436, 412, 468, and 466, are, thus, moved to the horizontal by retraction of driveshaft 424. Extension pressurization of air cylinder 426 causes the reverse of the movements described, resulting in downward rotation of the folding plates to the vertical. Note that clevis 454, attached to one end of air cylinder 426, allows the other end and driveshaft 424 to move up and down with respect to the frame. Such up and down movement occurs as the folding plates go from the vertical to the horizontal, and vice versa, because the bolt connecting driveshaft 424 to crank 414 follows an arcuate path. Movement of the folding plates to the horizontal allows the partially-erected strawberry lug to be pushed into the folding-ram station by the flight bar.

FIG. 13 shows the blank within the folding-ram station, the final station of the machine. Ram assembly 402 lies below the blank. Flanges 440 and stand-offs 450 are attached to plate 438, which is connected to lower frame 22. Mandrel 444 is attached to mandrel mount 446, which is connected to air cylinder shaft 452 and rods 448. Air cylinder shaft 452 moves within mandrel air cylinder 442 (double air-activated), and rods 448 move up and down within flanges 440. Standoffs 450 help gauge the spacing between the tip of mandrel 444 and the bottom of the blank. When mandrel 444 is fully retracted, such spacing is preferably from 0.25 to 0.50 inches. Also, the centerline of mandrel 444 preferably lies in the same vertical plane as the cut-score line between center tabs 328.

In FIG. 13, inner end panel flaps 338 and center wall panel flaps 336 are all inclined towards bottom wall panel 322. The blank is no longer carried by roller chains 50 or pushed by flight bar 54, and instead, the blank rides between rollers 406. Center tabs 328 are positioned directly above mandrel 444, which is retracted.

Figure 14:
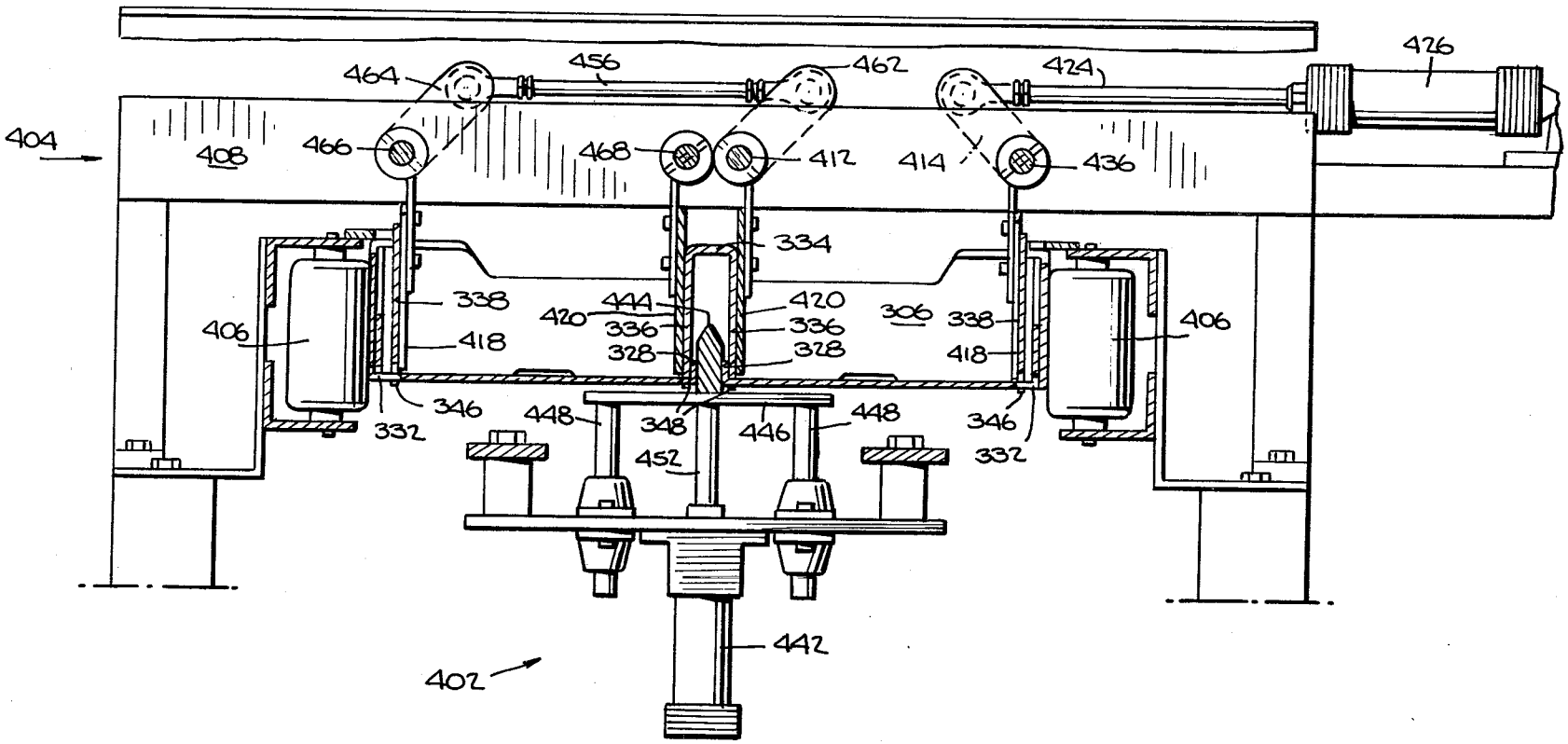

When the blank has completely entered the forming station, it no longer breaks the beam of light associated with photocell assembly 132 and reflector 120 (FIG. 14). This results in extension pressurization of mandrel air cylinder 442, which forces mandrel 444 upwardly, and in extension pressurization of air cylinder 426, which forces driveshaft 424 outwardly, causing all four folding plates to rotate downwardly.

Downward movement of outer folding plates 418 rotates flaps 338 downwardly and forces inner end panel tabs 346 into end tab holes 330. Downward movement of inner folding plates 420 rotates flaps 336 downwardly and forces center wall panel tabs 348 into center tab holes 326. The ends of tabs 346 and 348 project below the bottom of the strawberry lug. At the same time, upward movement of mandrel 444 pushes center tabs 328 from a horizontal to a vertical position.

The combined effect of the upward movement of mandrel 444 and downward rotation of inner folding plates 420 is to force each center wall panel flap 336 against its respective center tab 328. Glue previously applied to each flap 336 (see FIG. 11) secures the flap to the center tab it contacts.

In the finished strawberry lug, center wall panel flaps 336 are in a substantially parallel, spaced relationship, each secured to its respective upwardly folded center tab 328 and separated by transverse bridge panel 334. The hollow wall thus formed imparts greater strength and rigidity to the strawberry lug.

The leading edge of the next blank carried by roller chains 50 towards the folding-ram station interrupts the beam of light reflected from reflector 120 to photocell assembly 132. As explained above, this causes retraction pressurization of air cylinder 426, which, in turn, causes inner and outer folding plates 420 and 418 to return to the horizontal. Interruption of the light beam also causes retraction pressurization of mandrel air cylinder 442, which lowers mandrel 444 to the position shown in FIG. 13. Finally, movement of the next blank into the folding-ram station forces the strawberry lug just formed to move out of the station. The leading edge of the formed lug then breaks a light beam associated with a third photocell assembly (not shown). This activates a pusher assembly (not shown) to force the finished strawberry lug over a waterfall (not shown), from which it falls onto a stack of previously erected lugs.

As will be obvious to one skilled in the art, many modifications and variations in the present invention can be made. The claims are intended to cover all such modifications and variations.

I claim:

1. In a machine for erecting a shipping container tray from a blank, said tray having at least one hollow divider wall formed by (a) a transverse bridge, (b) first and second flaps hingedly connected to and downwardly extending from the transverse bridge, and (c) first and second tabs hingedly connected to and upwardly extending from the bottom of the tray, the first flap being secured by securing means to the first tab and the second flap being secured by securing means to the second tab, apparatus for forming the wall, comprising:

(a) means for folding the tabs towards the bridge into a substantially parallel, spaced relationship wherein the tabs are substantially perpendicular to the portion of the blank that forms the tray bottom; and (b) means for folding the flaps towards the tabs into a substantially parallel, spaced relationship wherein each flap contacts its respective tab.

2. The apparatus of claim 1 wherein the means for folding the tabs towards the transverse bridge comprises a reciprocating mandrel.

3. The apparatus of claim 1 wherein the means for folding the flaps towards the tabs comprises a pair of rotatably-mounted folding plates.

4. The apparatus of claim 1 further comprising means to apply the securing means to each flap-tab pair.

5. The apparatus of claim 4 wherein a glue gun is used to apply glue to secure each flap to its respective tab.

6. In a machine for erecting a shipping container tray from a blank, said tray having at least one hollow divider wall formed by (a) a transverse bridge, (b) first and second flaps hingedly connected to and downwardly extending from the transverse bridge, and (c) first and second tabs hingedly connected to and upwardly extending from the bottom of the tray, the first flap being secured by securing means to the first tab and the second flap being secured by securing means to the second tab, apparatus for forming the wall, comprising:

(a) first and second rotatably-mounted folding plates;

(b) a reciprocating mandrel movable in a direction substantially perpendicular to the portion of the blank that forms the bottom of the erected tray;

(c) means for positioning the blank so that the first flap is under the first folding plate, the second flap is under the second folding plate, and the mandrel is under the first and second tabs;

(d) means for causing the mandrel to move upward to fold the tabs upward into a substantially parallel, spaced relationship wherein the tabs are substantially perpendicular to the portion of the blank that forms the tray bottom;

(e) means for causing the plates to rotate downward to fold the flaps downward into a substantially parallel, spaced relationship wherein each flap contacts its respective tab;

(f) means for retracting the mandrel after each flap is secured to its respective tab; and (g) means for upwardly rotating the folding plates after each flap is secured to its respective tab.

7. The apparatus of claim 6 further comprising means to apply the securing means to each flap-tab pair.

8. The apparatus of claim 7 wherein a glue gun is used to apply glue to secure each flap to its respective tab.

9. The apparatus of claim 6 further comprising means to remove the tray from under the folding plates.

10. The apparatus of claim 6 further comprising first and second air cylinders wherein (a) the mandrel is connected to the first air cylinder, extension pressurization of which causes the mandrel to move upward; and (b) the folding plates are connected to the second air cylinder, retraction pressurization of which causes the plates to rotate upward.

11. In a machine for erecting a shipping container tray from a blank, said tray having (a) at least one hollow divider wall formed by (1) a transverse bridge, (2) first and second divider wall flaps hingedly connected to and downwardly extending from the transverse bridge, and (3) first and second tabs hingedly connected to and upwardly extending from the bottom of the tray, the first flap being secured by securing means to the first tab and the second flap being secured by securing means to the second tab; and (b) two end walls substantially parallel to the hollow divider wall and formed in part by first and second inner end flaps, each flap being folded downward from the top of its respective end wall; apparatus comprising:

(a) a frame having a top section and a bottom section;

(b) first and second inner folding plates, rotatably mounted in the top section of the frame;

(c) first and second outer folding plates, rotatably mounted in the top section of the frame;

(d) a first air cylinder, attached to the upper section of the frame and containing a piston connected to a driveshaft, wherein extension pressurization normally keeps the piston and driveshaft in an extended position and retraction pressurization of the air cylinder causes retraction of the piston and driveshaft;

(e) means connecting the driveshaft to the four folding plates so that retraction of the driveshaft causes the plates to rotate to a horizontal position and extension of the driveshaft causes the plates to rotate to the vertical;

(f) a second air cylinder, vertically mounted, attached to the lower section of the frame, and having a piston connected to a mandrel, wherein extension pressurization of the cylinder forces the mandrel up and retraction pressurization causes the mandrel to retract;

(g) means for sensing the approach of a blank to the frame wherein such approach causes retraction pressurization of the first air cylinder and retraction pressurization of the second air cylinder, thereby causing the four folding plates to rotate to the horizontal and causing the mandrel to retract;

(h) means for positioning the blank after the mandrel is retracted and the four folding plates are horizontal so that the first and second inner folding plates are above the first and second divider wall flaps, respectively, the first and second outer folding plates are above the first and second inner end flaps, respectively, and the mandrel is below the first and second tabs;

(i) means for causing extension pressurization of the first air cylinder and extension pressurization of the second air cylinder after the blank is positioned as in (h), thereby forcing the mandrel up to fold the first and second tabs up and moving the four folding plates to the vertical to rotate the four flaps to the vertical so that each of the first and second divider wall flaps contacts its respective tab, and each of the first and second inner end flaps becomes part of its respective end wall; and (j) means to apply the securing means to each divider wall flap-tab pair.

12. The apparatus of claim 11 wherein glue is the securing means.

* * * * *

UNITED STATES PATENT AND TRADEMARK OFFICE

CERTIFICATE OF CORRECTION

PATENT NO. : 4,217,815

DATED : August 19, 1980

INVENTOR(S) : Ulrich G. Nowacki

It is certified that error appears in the above—identified patent and that said Letters Patent is hereby corrected as shown below:

column 1, line 16, change "17" to --27--; line 31, change "3,978,744" to --3,978,774--;
column 2, line 3, change "objections" to --objectives--;
column 3, line 34, change "limited" to --limiter--;
column 4, line 37, change "ocnnecting" to --connecting--; line 50, change "connected rod 412" to --connecting rod 422--; and
column 5, line 19, change "341" to --342--.

Signed and Sealed this

*Fourteenth* Day of *April 1981*

[SEAL]

*Attest:*

RENE D. TEGTMEYER

*Attesting Officer*

*Acting Commissioner of Patents and Trademarks*